US009175496B2

(12) United States Patent
Darquea et al.

(10) Patent No.: US 9,175,496 B2
(45) Date of Patent: Nov. 3, 2015

(54) PORTABLE SUNSHADE DEVICE HAVING HOLDER FOR SHADED VIEWING OF PORTABLE MEDIA DEVICES

(71) Applicant: Shadyface.com, San Jose, CA (US)

(72) Inventors: Patricia H Darquea, San Jose, CA (US); Charles Darquea, San Jose, CA (US); Ryan Teixeira, Santa Clara, CA (US)

(73) Assignee: SHADYFACE.COM, San Jose, CA (US)

( * ) Notice: Subject to any disclaimer, the term of this patent is extended or adjusted under 35 U.S.C. 154(b) by 0 days.

(21) Appl. No.: 13/901,556

(22) Filed: May 23, 2013

(65) Prior Publication Data

US 2014/0150837 A1 Jun. 5, 2014

Related U.S. Application Data

(60) Provisional application No. 61/698,472, filed on Sep. 7, 2012.

(51) Int. Cl.

| | |
|---|---|
| ***E04H 15/02*** | (2006.01) |
| ***E04H 15/00*** | (2006.01) |
| *A45B 23/00* | (2006.01) |

(52) U.S. Cl.

CPC ..... *E04H 15/003* (2013.01); *A45B 2023/0006* (2013.01)

(58) Field of Classification Search

USPC ..... 135/96, 117

See application file for complete search history.

(56) References Cited

U.S. PATENT DOCUMENTS

| | | | | | |
|---|---|---|---|---|---|
| 225,372 | A * | 3/1880 | Herbert | 135/155 |
| 1,536,665 | A * | 5/1925 | Fargo | 160/351 |
| 1,605,679 | A * | 11/1926 | McGrail | 297/184.15 |
| 2,109,881 | A * | 3/1938 | Goldberg | 5/418 |
| 2,290,786 | A * | 7/1942 | Varady | 5/418 |
| 2,499,897 | A * | 3/1950 | Winquist | 135/151 |
| 2,561,886 | A * | 7/1951 | Rikelman | 297/357 |
| 2,584,432 | A * | 2/1952 | De Marco | 135/95 |
| 2,598,588 | A * | 5/1952 | Mullen | 135/155 |
| 3,162,206 | A * | 12/1964 | Betts | 135/90 |
| 3,738,703 | A * | 6/1973 | Kunimatu | 297/184.15 |
| 4,295,481 | A * | 10/1981 | Gee | 52/64 |
| 4,796,734 | A * | 1/1989 | Distasio | 190/1 |
| 4,957,261 | A * | 9/1990 | Cirami | 248/454 |
| 5,025,821 | A * | 6/1991 | Page et al. | 135/161 |
| 5,551,110 | A * | 9/1996 | Armstrong et al. | 5/656 |
| 5,582,458 | A * | 12/1996 | Wildt | 297/184.15 |
| 5,720,465 | A * | 2/1998 | Peltzer et al. | 248/453 |
| 5,752,537 | A * | 5/1998 | Kranzler | 135/128 |
| 7,080,812 | B2 * | 7/2006 | Wadsworth et al. | 248/316.6 |
| 7,997,291 | B2 * | 8/2011 | Gressette et al. | 135/96 |
| 8,002,349 | B1 * | 8/2011 | Pizzuto | 297/217.3 |
| 8,186,755 | B2 * | 5/2012 | Lovley | 297/184.15 |
| 2006/0049672 | A1 * | 3/2006 | Terrell | 297/17 |

(Continued)

*Primary Examiner* — Noah Chandler Hawk

(74) *Attorney, Agent, or Firm* — Robert D. Becker; Manatt, Phelps & Phillips

(57) ABSTRACT

A sun shading device having a shading canopy, a back shading panel, attached to legs. The legs and canopies are collapsible. The underside of the shading canopy includes a viewable electronic device holder for holding devices such as touch screen tablet computers or other device having a view screen. The shading canopy and the back shading panel of the sun shading device provide a shaded alcove in which a user can lie on his or her back to view an electronic device screen secured to the underside of the shading canopy.

8 Claims, 8 Drawing Sheets

(56) References Cited

U.S. PATENT DOCUMENTS

2006/0261652 A1* 11/2006 Tseng ..... 297/277
2008/0087779 A1* 4/2008 Liow et al. ..... 248/206.5
2011/0315733 A1* 12/2011 White ..... 224/600
2014/0138419 A1* 5/2014 Minn et al. ..... 224/567

* cited by examiner

PORTABLE SUNSHADE DEVICE HAVING HOLDER FOR SHADED VIEWING OF PORTABLE MEDIA DEVICES

CROSS-REFERENCE TO RELATED APPLICATIONS

This application claims priority to U.S. Provisional Patent Application No. 61/698,472, filed Sep. 7, 2012, the entirety of which is hereby incorporated by reference as if fully set forth herein.

TECHNICAL FIELD

These illustrated devices relate to sun shading devices and more specifically to a personal sun shading device configured to be used with a personal electronic device that has a screen.

BACKGROUND OF THE INVENTION

Personal shading devices are useful at beaches, parks and other recreational areas to keep sun off of a user's face and upper body. Optimally, such a device would allow for reduced glare viewing of electronic devices. The present embodiments are directed to provide a solution to this need.

DETAILED DESCRIPTION

The present embodiments provide a device that allows a user to enjoy viewing the screens of electronic devices even in bright sunlight, such as by a swimming pool, at the beach, at a park, or other outdoor locations. This device reduces screen glare while the user is kept cool under the shade of a positionable canopy.

Figure 1:
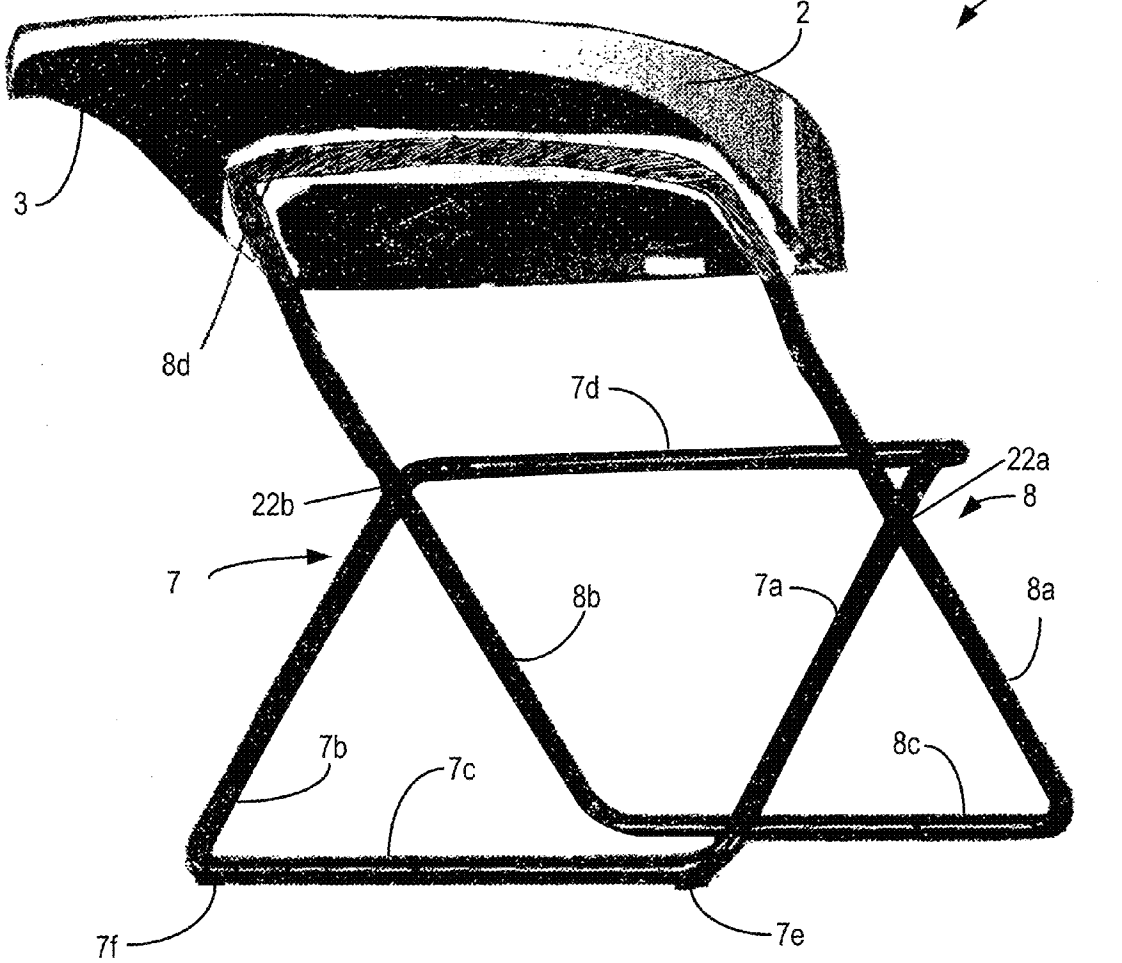
FIG. 1 is a front perspective view of a sun shade, according to some embodiments.

With reference to FIG. 1, a device according to some embodiments is shown from the front, with canopy 20 tilted upward. The canopy includes an inner ring 1 (shown in exploded view in FIG. 3), a canopy shell 2 and a canopy shade fabric 3 held within canopy shell 2. The canopy is mounted on the upper portion of rear leg set 8. In the illustrated embodiment, rear leg set 8 is a rectangular tube pivotably mounted to a front leg set 7. The rectangular tube forming rear leg set has a rear first side leg section 8*a* and a rear second side leg section 8*b*. Rear leg set 8 is shown having a rear lower horizontal cross bar 8*c* extending between rear first side leg section 8*a* and rear second side leg section 8*b*. In addition, the rear leg set 8 also has an upper horizontal cross bar 8*d* onto which the canopy 20 is pivotably mounted. It is preferred that the canopy pivot be an eccentric pivot. By having an off-centered (eccentric) pivot allows the shade to maximize the casted shadow footprint and adjustability while keeping the overall size small.

This allows a user to protect her face from the sun during a sunset when it is shining horizontally to the ground.

Other embodiments, in which cross bars are not used, are also contemplated. In such embodiments, the rear leg set would have two elongate legs. One end would contact the surface on which the device rests. The other end would serve as the mount of the canopy, using a ball mount, pins extending through the legs, a curved end to the legs or other canopy mounting means.

The rear leg set 8 is joined to a front leg set 7. As shown, the front leg set is a tube bent into essentially the shape of a square with rounded corners. The square tube forming front leg set has a front first side leg section 7*a* and a front second side leg section 7*b*. In one embodiment, the term "square tubing" does not refer to the cross section, which in the illustrated embodiment is round. Instead, the square tube refers to the legs and horizontal crossbars, which form an essentially square shape. Front leg set 7 is shown having a front lower horizontal cross bar 7*c* extending between front first side leg section 7*a* and front second side leg section 7*b*. At the end of first side leg section 7*a* and a second side leg section 7*b* are front leg feet 7*e* and 7*f*. If no horizontal cross bar is included, the feet alone would contact the ground when the device is in use, rather than a horizontal bar. The front first side leg section 7*a* is joined to rear first side leg section 8*a* at pivot 22*a*, and front second leg section 7*b* is joined to rear second leg section 8*b* at pivot 22*b*. Front leg set 7 also includes an upper horizontal cross bar 7*d*.

Figure 2:
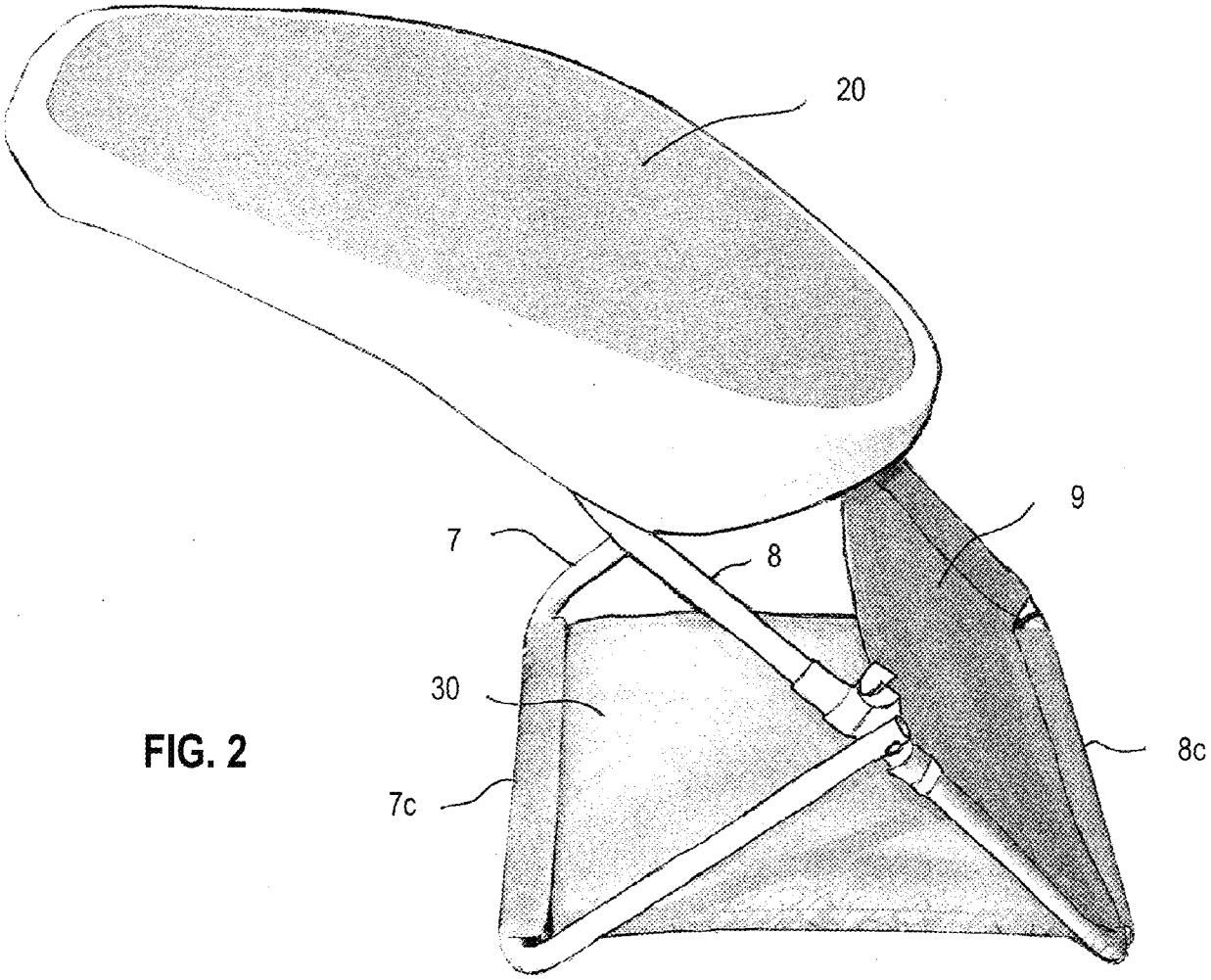
FIG. 2 is a back perspective view of a sun shade, according to some embodiments.

With reference to FIG. 2, the rear view of the device shows canopy 20 as held by rear leg set 8 joined to front leg set 7. Mounted on the vertical sections of rear leg set 8 is a back fabric panel 9. This panel may be removably mounted to the vertical sections between the locations that pivotably join back leg set 8 to front leg set 7. This may be done using "hook and eye" type fasteners, snap type fasteners, or other fasteners. For example the "hook" portion of the hook and eye type fasteners would be spaced from the "eye" portion of the hook and eye type fasteners extending near the edge of the fabric with the spacing just greater than the circumference of the leg tube. A ground fabric 30 is removably mounted between the front leg set lower horizontal cross bar 7*c* and rear leg set lower horizontal cross bar 8*c*.

Figure 3:
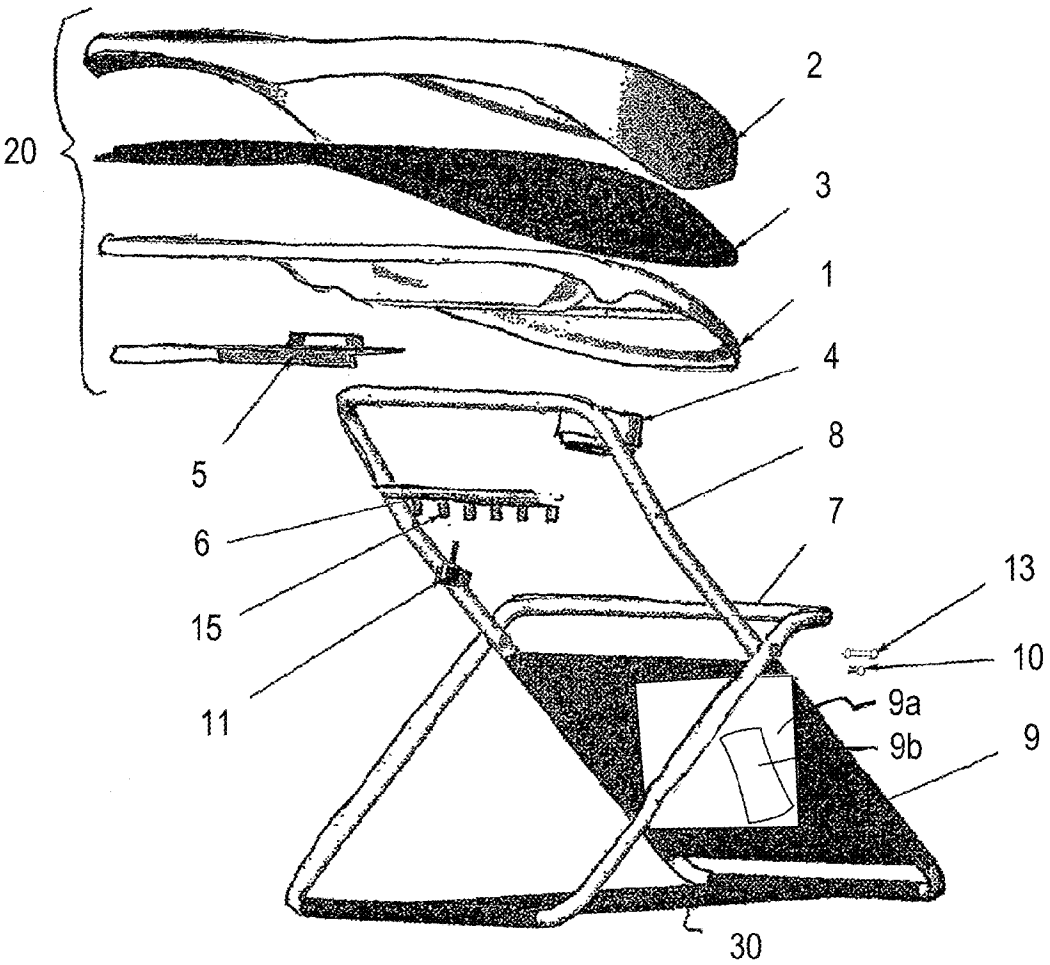
FIG. 3 is an exploded view of the sunshade of FIG. 1, according to some embodiments.

With reference to FIG. 3, an exploded view of the device shows various component parts. The canopy 20 of the device is comprised of an inner ring 1, a canopy shell 2 and a canopy shade fabric 3 held between the inner ring 1 and the canopy shell 2. According to some embodiments, mounted on inner ring 1 is device holder 5 and speaker holder 4.

Figure 7:
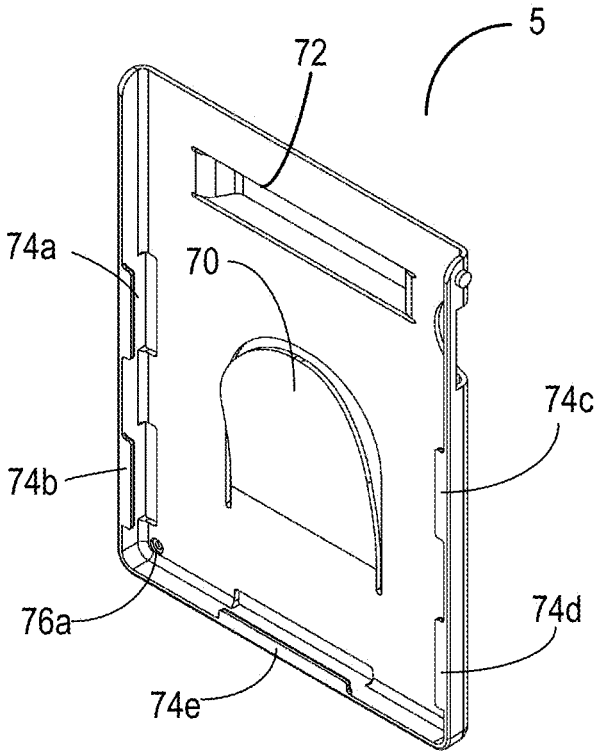
FIG. 7 is a front perspective view of the device holder, according to some embodiments.

With reference to FIG. 7, the device holder 5 is shown having screw holes 76*a* for mounting device holder 5 to inner ring 1 shown in FIG. 3. Protruding section 72 also is used for mounting to inner ring 1, and may be snap fit or secured by epoxy to a cross bar on the inner ring 1. Returning to FIG. 7, the two sides of device holder 5 and the bottom of device holder 5 have edge retainers 74*a*, 74, b, 74*c*, 74*d*, and 74*e*. These edge retainers hold the edges of a user's portable screen device.

While the device is shown with device holder 5, it is understood that other device holders may be mounted to inner ring 1 of canopy 20 without departing from the spirit of embodiments of the invention.

In this application, a "portable screen device" is any device designed for a user to carry and that can be configured to have a view screen that extends for a substantial length of the device. In some embodiments, the view screen extends for 75% or more of the length of one side of the device. The view screen may also be a touch screen that receives user's input by detecting a user's contact with the screen. This group would include smart phones, tablet computers, electronic book readers, convertible notebook computers (devices which have an integrated keyboard that can be hidden by a swivel joint or slide joint), hybrid tablets that have a detachable keyboard, allowing so that the touch screen can be used as a stand alone device. In some embodiments, "portable screen devices" either have (in the case of smart phones, tablet computers or electronic book readers) or have in some configurations (as in the case of convertible notebook computers, convertible smart phone devices, or hybrid tablets) an ability to have a substantially uniform thickness allowing the device to be held in a device holder in with the edges of the portable screen device are secured, allowing viewing of the screen. In some embodiments, a device holder is used to which a variety of shapes of portable screen devices may be secured. For convertible screen devices and hybrid tablets, the screen extending 75% of the length of the device is determined in the configuration in which the retractable portion has retracted or the detachable portion has detached.

As shown in FIG. 7, device holder 5 includes a spring 70. Spring 70 allows devices of different thickness to be secured into device holder 5, and retained against edge retainers 74*a-e*.

Returning to FIG. 3, the canopy 20 is pivotably held on rear leg set upper cross bar 8*a*, by lockbar 6, which is secured to a middle horizontal crossbar 1*b* on inner ring 1. A three arm knob 11 has a threaded cylindrical bolt that is screwed through threads on lockbar 6 and may be frictionally held on rear leg set upper cross bar 8*a*. This allows knob 11 to secure the canopy 20 at a desired angle on rear leg set upper cross bar 8*a*. The lockbar 6 has edge flanges that are secured by screws 15 to middle horizontal crossbar 1*b* on inner ring 1. In some embodiments, the mass of the canopy is designed to be balanced (does not rotate on upper cross bar 8*d*, with reference to FIG. 1, due to one side of the canopy being exceedingly heavier than the other.)

On FIG. 3, in some embodiments, the front leg set 7 and rear leg set 8 are joined by two piece rivet 10, 13. This could also be a bolt and nut, a bolt and pin, or other securing means. As was shown in FIG. 2, the back of the device includes back fabric 9 secured to the length of the side legs of the rear leg set from the location where the front and back leg set are pivotably joined, to the location proximate to the bottom horizontal crossbar. This back fabric provides some shade on the back of the device from sun, further reducing glare. In some embodiments, on the back fabric 9 are pockets 9*a*, 9*b*, allowing a user to store devices such as a cell phone. A ground fabric 30 is secured to the lower cross bars of the front leg set 7 and rear leg set 8 as previously described.

Figure 4:
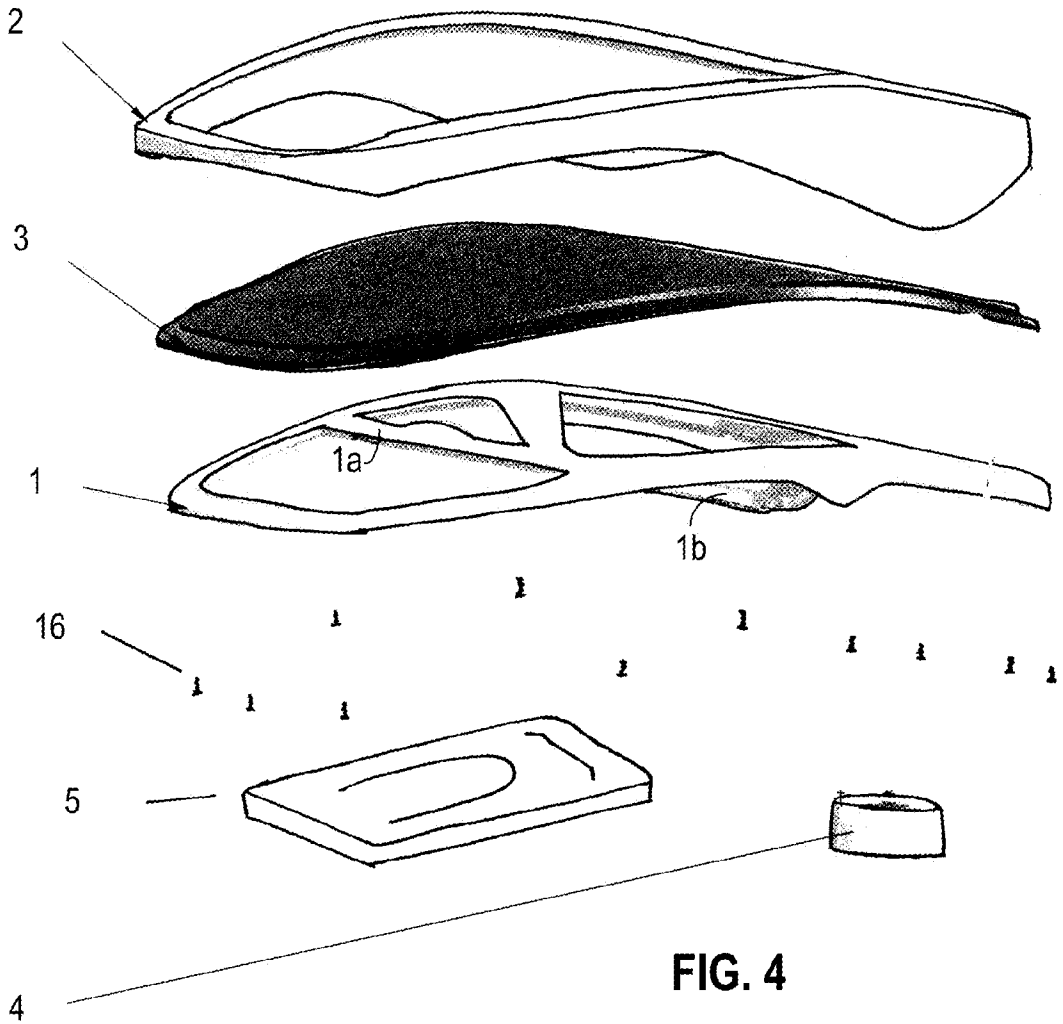
FIG. 4 is an exploded view of the canopy of FIG. 1, according to some embodiments.

FIG. 4 illustrates an exploded view of the canopy according to some embodiments. FIG. 4 shows the canopy shell 2, the inner ring 1, and the canopy fabric 3 positioned between the two. The inner ring 1 is secured to canopy shell 2 by a plurality of screws 16. In some embodiments, a spray adhesive foam is used for attaching canopy fabric 3 to inner ring 1. Inner ring 1 is then sandwiched together with canopy shell 2 using screws 16. A pair of screws also secure device holder 5 to inner ring 1. In some embodiments, speaker holder 4 is attached to inner ring 1, by methods such as by magnet, by clip or other fastener, by bolts and nuts, or any fastener capable of mounting speaker holder 4 to the device.

Figure 8:
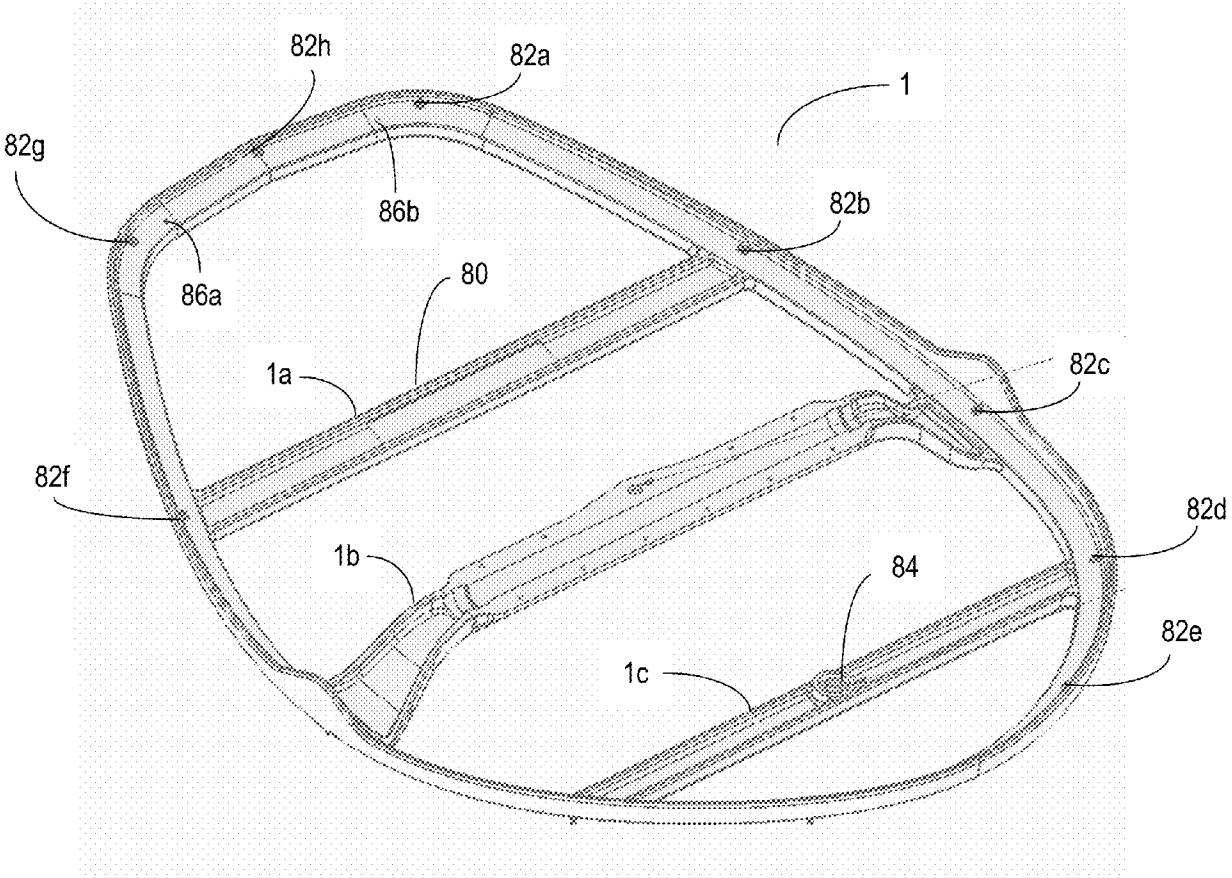
FIG. 8 is a bottom view of the canopy inner ring, according to some embodiments.

With reference to FIG. 8, the underside view of inner ring 1 shows a first cross bar 1*a* having a holder mount 80 which allows the protruding section 72 of device holder 5 shown in FIG. 7 to be mounted to the inner ring 1. The lower end of device holder 5 is secured by two screws, attached though holes 86*a*, 86*b*. Around the peripheral edge of inner ring 1 are holes 82*a*-82*h*. The use of these holes 82*a*-82*h* can be seen in FIG. 4. In FIG. 4, screws 16 are used to attach inner ring 8 to canopy shell 2. The screws extend through canopy fabric 3, attaching canopy fabric 3 to canopy shell 2 (as seen in FIG. 4).

Returning to FIG. 8, a middle inner shell cross bar 1*b* allows attachment to the lock bar, as described in relation to FIG. 3. In some embodiments, a rear cross bar 1*c* includes a magnetic speaker mount for magnetically holding speaker holder 4, seen in FIGS. 3 and 4.

Figure 6:
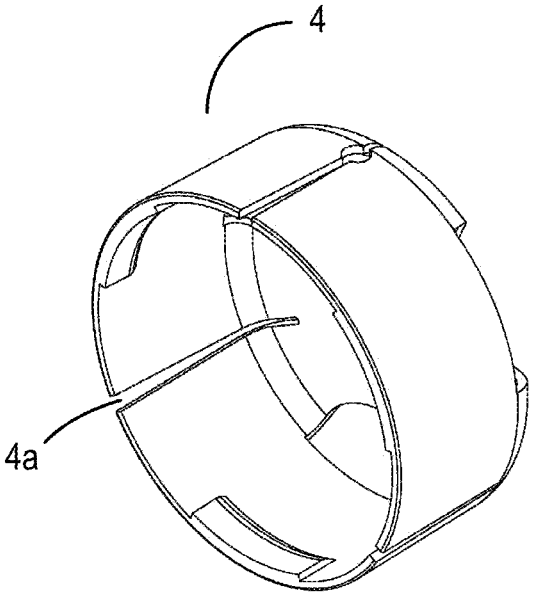
FIG. 6 is a side perspective view of the speaker holder, according to some embodiments.

FIG. 6 illustrates a speaker holder 4 according to some embodiments. Speaker holder 4 has internal ribs 4*a*, which allow frictional holding of a speaker such as a wireless speaker. While shown in FIG. 6 as ring-shaped holder, other shapes of speaker holders may be used with the device without departing from the spirit of the invention.

Figure 5:
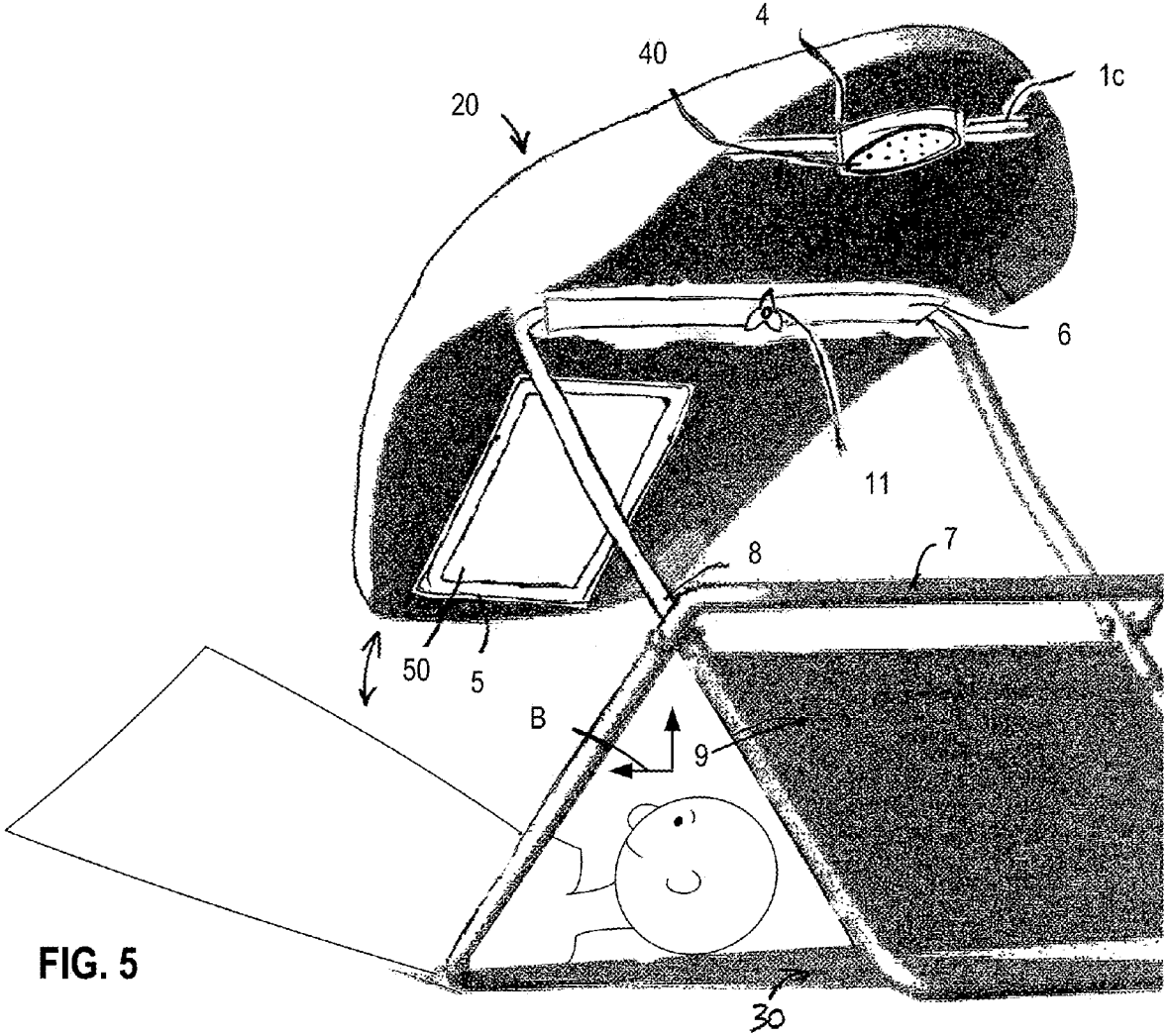
FIG. 5 is a rear perspective view of the sun shade of FIG. 1 while holding a portable view screen device, a user viewing the device, according to some embodiments.

With respect to FIG. 5, a user 100 is shown using the device. The user may either lay with head in front of bottom fabric 30, or can lay with the head on fabric 30 and the front lower cross bar at the user's neck. Canopy 20 is shown proving shade to the user and holding view screen device 50 in device holder 5. The lock bar 6 mounted on middle horizontal crossbar 1*b* allows the canopy to be pivotably positioned. Once the desired position is reached, the knob 11 is tightened, securing the canopy at the desired angle. Arrows A and B illustrate the arc in which viewing is possible, from the view screen being directly above the user, to the screen being nearly vertical in front of the user. Throughout these positions, the canopy will be stable. The back fabric panel 9 provides additional shade from the sun glare, and bottom fabric panel 30 both defines the maximum separation of the front and rear leg sets 7 and 8 and provides greater stability. The speaker 40 held in speaker holder 4 allows music or other sound to be produced, using a wireless connection to a device. In some embodiments, the speaker holder is magnetically mounted on rear cross bar 1*c* of the inner ring 1. The sides of the canopy define a shaded viewing alcove and further reduce glare.

Other accessories or mounts for mounting accessories may be mounted to any portion of the device, including to inner ring 1, canopy shell 2, or canopy shade fabric 3. For example, a solar panel, a battery pack, or a solar-panel-chargeable battery pack with USB device charging connectivity may be mounted to the device for charging the portable screen device while it is secured to the device holder. In some embodiments, a power socket and power cord may be mounted to provide a mains or plug-in power supply for use.

The shading device allows a user to place a portable view screen device in the canopy alcove and view the screen without glare. A user could read an electronic book using an e-reader, view a movie or other video content, or read e-mail, visit Internet sites or play games using a wireless controller. At the same time, the device could stream music to the speakers, allowing audio from the device held in the canopy, or from another device held in the pockets of the back fabric panel.

The device may be used on lawns, on sand, by a pool, on a lounge chair, or other locations where shade is desired. The device can be used by adults, children, pets or by parents with infants. For an example an infant could be placed on the ground fabric. The back fabric and canopy would shade the infant from the sun while listening to the wireless blue tooth speaker, providing ample sun shade and wind block protection when resting underneath. Another example of the embodiments of the device in use would be for pets. Two small dogs or one large dog can be shaded from the sun when placed under the device as illustrated in the embodiments.

Shadyface is provides a solution for using electronic media under a covered canopy shade allowing reduced glare viewing from the sun whether one uses tablets, smart phones, mobile flatscreen televisions, e-book readers, or other media players/view screen devices.

Figure 9:
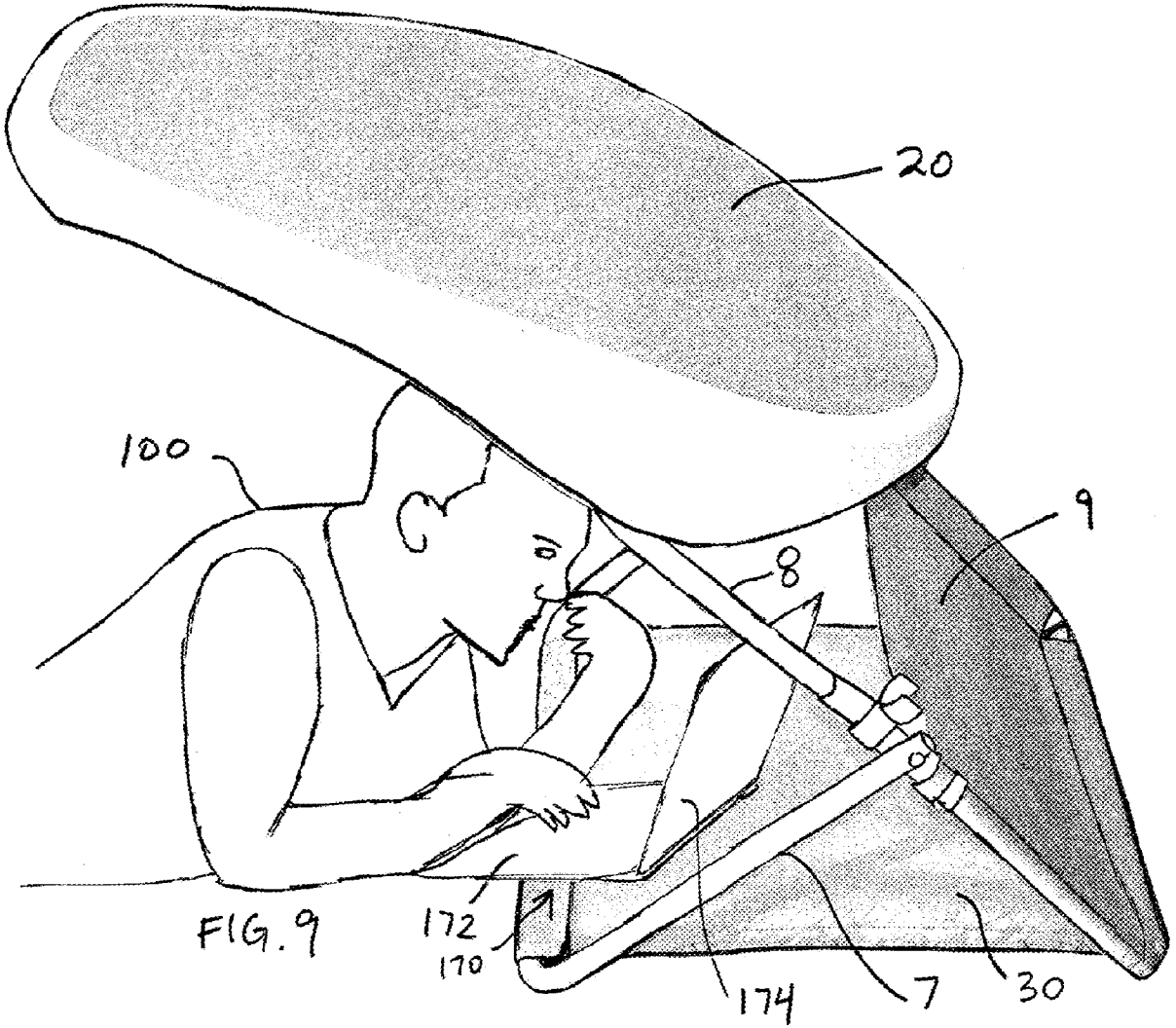
FIG. 9 is a side view of a user using a laptop while shaded by the canopy of a shading device, according to some embodiments.

As shown in FIG. 9, a laptop can be used on the ground when a user is lying on his or her stomach. Resting on bottom canvas 30 is clam shell laptop 170 having a screen 174 and hingedly joined keyboard 172. The user 100 can use this clamshell laptop 174 while lying front down. The back fabric 9 provides some protection from glare. In some embodiments, the off-centered pivot allows the canopy shade to lower all the way down to the lower back while a person is using a computer in bright sunlit areas.

The shading device provides a greatly reduced glare when viewing screen 174, whether looking up at a viewable device held in the device holder, or lying front down and using a conventional clam shell laptop.

Additional features could be added to the device. For example, in one embodiment, handles may be stitched onto the back side of the canvas for easy carrying.

We claim:

1. A user shading device comprising:

a front leg set;

a rear leg set pivotably joined to said front leg set such that said front leg set and said rear leg set may be positioned in a collapsed position and unfolded into a shading position, wherein said rear leg set has a feet location for contact with a horizontal surface and an upper canopy mounting location;

a shading canopy comprising a canopy shell connected to an inner ring, said canopy shell and said inner ring securing a shading fabric, said shading canopy pivotably attached at a shading canopy midsection mount of said inner ring to said rear leg set at said upper canopy mounting location, said shading canopy defining a shading alcove;

and a viewable device holder secured into said shading canopy, such that when a viewable device is secured into said viewable device holder and said rear leg set and said front leg set are unfolded into said shading position, said shading canopy providing a shaded view space for said viewable device, wherein said viewable device holder includes a biasing member positioned to allow said viewable device holder to hold a variety of thicknesses of viewable devices, said biasing member biasing said viewable devices against holder edge retainers.

2. The device of claim 1, further configured to removeably hold a speaker to a portion of said shading canopy.

3. The device of claim 2, wherein said device is configured with a speaker holder for removeably holding said speaker, said speaker holder is magnetically attached at an attachment location located at a rear portion of said shading canopy.

4. The device of claim 1, further including a bottom fabric panel extending between and securable to said front leg set and said rear leg set.

5. The device of claim 1, further including a back fabric panel extending between said rear leg set and secured between said feet location and a leg set pivot location, said back fabric panel having a plurality of pockets with openings facing said front leg set.

6. The device of claim 1, wherein each of said front leg set and said rear leg set include a continuous metal tube, defining for each of said front leg set and said rear leg set an upper and lower cross bar.

7. The device of claim 1, further including a user adjustable member for securing said shading canopy at a selected tilt angle.

8. The device of claim 1, wherein said biasing member is a spring.

* * * * *